US006343626B1

(12) United States Patent
Demey et al.

(10) Patent No.: US 6,343,626 B1
(45) Date of Patent: Feb. 5, 2002

(54) METHOD FOR FACE-TO-FACE WEAVING FALSE BOUCLE FABRICS WITH CUT PILE, AND FABRICS WOVEN ACCORDING TO THIS METHOD

(75) Inventors: Stefaan Demey, Brugge-St. Michiels; Ludo Smissaert, Assebroek, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/619,653

(22) Filed: Jul. 19, 2000

(30) Foreign Application Priority Data

Jul. 19, 1999 (BE) ..... 09900493

(51) Int. Cl.[7] ..... D03D 27/00; D03D 27/10; D03D 39/18

(52) U.S. Cl. ..... 139/398; 139/392; 139/37; 139/435.1; 139/383 R; 139/404; 139/402

(58) Field of Search ..... 139/392, 398, 139/37, 435.1, 383 R, 404, 418, 391, 402

(56) References Cited

U.S. PATENT DOCUMENTS 2,060,502 A 11/1936 Kaufman
2,108,046 A 2/1938 Drobile
3,289,706 A 12/1966 Valentine
6,173,746 B1 * 1/2001 Debaes ..... 139/392
6,186,189 B1 * 2/2001 Gheysen ..... 139/392

FOREIGN PATENT DOCUMENTS

EP 1013805 * 6/2000 ..... D03D/27/10
EP 1072705 * 1/2001 ..... D03D/27/10
EP 1081260 * 3/2001 ..... D03D/27/06

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

Method for weaving fabrics with a rib structure, whereby on a weaving machine, two fabrics (22), (23); (49), (50) are woven one above the other with a rib structure according to a face-to-face weaving method, whereby each fabric comprises a backing fabric with rib warp yarns (15), (16), (17), (18); (43), (44), (45), (46) which are alternately woven in the backing fabric and are rib-formingly passed around over at least one weft yarn (4), (5), (32), (33) whereby pile warp yarns (19), (20); (47); are alternately interlaced in the top (21); (49) and the bottom fabric (22); (50) around at least one weft yarn (1), (2), (3), (6); (31), (36), and whereby these pile warp yarns (19), (20); (47) are split between the two fabrics so that two fabrics (22), (23); (49), (50) with a rib structure are obtained which also comprise at least one area with upright pile yarns.

14 Claims, 1 Drawing Sheet

METHOD FOR FACE-TO-FACE WEAVING FALSE BOUCLE FABRICS WITH CUT PILE, AND FABRICS WOVEN ACCORDING TO THIS METHOD

BACKGROUND OF THE INVENTION

This invention relates to a method for weaving fabrics with a rib structure, whereby on a weaving machine a backing fabric is woven out of weft yarns and warp yarns, and whereby warp yarns are alternately woven into in the backing fabric and are rib-formingly passed around over at least one weft yarn extending on the backing fabric surface.

This invention also relates to fabrics with a rib structure and more especially to fabrics which approximate the appearance of a loop pile fabric or bouclé fabric, and are in general referred to by the name of "false bouclé fabrics", in which rib warp yarns are alternately woven into in the fabric and are rib-formingly passed around at least one weft yarn.

This invention relates in particular to a so-called false bouclé carpet and a weaving method for manufacturing such a carpet.

According to a known method for manufacturing these types of carpets on a weaving machine a series of warp yarn systems are provided each of which comprises two pattern warp yarns, and in successive weft insertion cycles in each case two weft yarns are inserted one above the other in respective sheds between these warp yarns. With each weft insertion the warp yarns are brought into such positions in relation to the weft insertion levels that the pattern warp yarns bind the weft yarns, so that a fabric is formed, in which tension warp yarns are woven into, in which the pairs of weft yarns inserted in successive cycles extend alternately above and below these tension warp yarns, in which per warp yarn system a first pattern warp yarn extends alternately above a pair of weft yarns extending along the upper of the fabric and between the weft yarns of a pair of weft yarns located along the back side of the fabric, and a second pattern warp yarn extends alternately between the weft yarns of a pair of weft yarns located along the upper of the fabric and under a pair of weft yarns extending along the lower side of the fabric. A fabric is thus obtained of which both the upper and the back side show a rib structure. In the course of the successive weft insertion cycles a rib line is produced alternately along the upper side and along the back side of the fabric. If the first and the second pattern warp yarn have a different color a two-color design or pattern can be made visible on the upper side of the fabric. On the back side of the fabric a type of negative (with swapped colors) is obtained of the design which is visible on the upper side of the fabric.

A disadvantage of this weaving method is that it only enables a medium productivity. Furthermore the patterns or designs provided on these fabrics only have two different colors.

SUMMARY OF THE INVENTION

The purpose of this invention is to provide a method for manufacturing a fabric with a rib structure, with which on the one hand a higher productivity can be achieved and with which on the other hand more variation can also be brought into the appearance of the fabric.

This objective is achieved according to this invention with a method having the characteristics mentioned in the first paragraph of this specification, by weaving two fabrics one above the other with a rib structure according to a face-to-face weaving method, while warp yarns are alternately interlaced in the top and the bottom fabric around at least one weft yarn, and cutting through these warp yarns between the two fabrics so that each fabric with a rib structure also comprises at least one area with cut pile yarns.

According to this method two fabrics with a rib structure are woven simultaneously so that the productivity is doubled in comparison to existing methods. The one or several area(s) with cut pile provide a much more varied appearance of the fabric top. The rib structure gives a bouclé effect (this is the effect of a loop pile fabric) in the fabric, while the cut pile produces a so-called plush effect (the effect of a pile or velvet fabric). According to this weaving method false bouclé plush carpets can more specifically be woven in a very productive manner.

With this method preferably two backing fabrics located one above the other are woven respectively out of weft yarns and binding warp yarns, while the weft yarns over which warp yarns are rib-formingly passed around extend outside these backing fabrics over the backing fabric surface. Because of this these weft yarns come to lie higher so that a clearer rib structure is obtained.

If these warp yarns are furthermore rib-formingly passed around over weft yarns which belong to a set of at least two weft yarns located one above the other, still higher ribs are obtained so that a very clear rib structure is obtained.

For example a set of weft yarns located one above the other and one single interjacent weft yarn can be provided alternately in each fabric.

In order to achieve a very clear bouclé effect for the weft yarns over which ribs are formed a thicker weft yarn is used than for the other weft yarns. This makes the rib height still higher.

It is furthermore also preferable to inweave tension warp yarns into each backing fabric.

In order to weave fabrics of a high quality, non-rib-forming and non-pile-forming warp yarns are divided among the top and the bottom fabric woven into these fabrics, and moreover extend between the weft yarns over which ribs are formed and the other weft yarns (woven into in the backing fabric) of the fabric.

These woven in warp yarns hold the weft yarns, over which ribs are formed, well out of the backing fabric through which a pronounced bouclé effect is obtained.

According to a first preferred method the weft yarns are in the course of successive series of four successive operating cycles of the weaving machine weft insertion means inserted in respective sheds between the warp yarns, whereby in the first cycle of each series one weft yarn is inserted for the top fabric, in the second cycle of each series one weft yarn is inserted for the bottom fabric, in the third cycle of each series two weft yarns are inserted one above the other for the top fabric, and in the fourth cycle of each series two weft yarns are inserted one above the other for the bottom fabric.

The weaving machine utilized for this method is preferably provided with two weft insertion means in order to insert two weft yarns one above the other in the course of the same operating cycle. In the course of the cycles in which only one weft yarn is inserted, one of the two weft insertion means is then disengaged or no weft yarn is proferred to one of these weft insertion means.

According to a second preferred method the weft yarns are in the course of successive series of two successive operating cycles of the weaving machine weft insertion means inserted in respective sheds between the warp yarns, whereby in each series in one cycle two weft yarns are inserted one above the other for the bottom fabric and one weft yarn is inserted for the top fabric, and in the other cycle two weft yarns are inserted one above the other for the top fabric and one weft yarn is inserted for the bottom fabric.

This method is very efficient. Per two successive weft insertion cycles a rib line can be produced at the same time in two fabrics. In comparison to the above described first preferred method this method doubles the productivity.

The weaving machine utilized for this method in preferably provided with three weft insertion means in order to insert three weft yarns one above the other in the course of the same operating cycle.

In order to achieve the effect of long loops at least one warp yarn can be allowed to extend rib-formingly over two or more successive weft yarns of a fabric without interjacent interlacing in the fabric.

This invention also relates to a fabric with a rib structure, in particular a false bouclé fabric, as described in the second paragraph of this specification, which also comprises at least one area with cut pile.

The fabric according to this invention is preferably manufactured according to the method of this invention, and is in its most preferred form a so-called false bouclé carpet with plush effects.

In that which follows two methods according to this invention are described in detail. The purpose of this specification is only to clarify further the aforesaid characteristics of the method and of the fabrics manufactured according to this method, and to specify further properties and distinctive features thereof, and may therefore in no way be considered as a restriction on the protection claimed for this invention in the claims of this patent application.

In this specification reference is made by means of reference numbers to the figures attached hereto, of which FIG. 1 is a schematic cross-section according to the warp direction of a false bouclé carpet that has been woven according to a first method according to this invention.

FIG. 2 is a schematic cross-section according to the warp direction of a false bouclé carpet that has been woven according to a second method according to this invention.

According to a first preferred weaving method according to this invention use is made of a known face-to-face weaving machine with a weft insertion mechanism that comprises two rapier devices operating one above the other which are controllable in order in each operating cycle to bring a respective weft yarn through a shed between warp yarns, and furthermore also comprises a presenting means for each rapier device that is controllable in order in each operating cycle to present a weft yarn to a respective rapier. This weft insertion mechanism is therefore provided in order in each operating cycle to insert two weft yarns simultaneously one above the other.

DETAILED DESCRIPTION

On this face-to-face weaving machine a series of warp yarn systems is provided, each of which comprises four binding warp yarns (11), (12), (13), (14), two tension warp yarns (9), (10), four rib warp yarns (19), (20) and two pile warp yarns.

Figure 1:
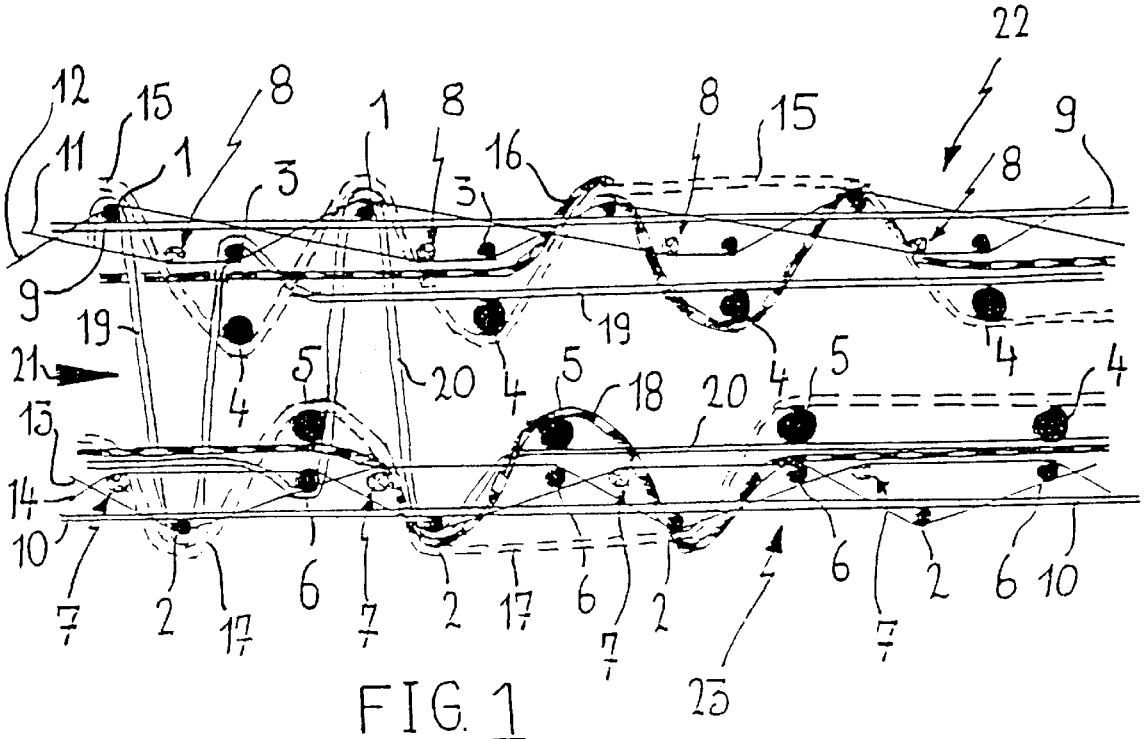
FIG. 1 is a schematic view of a weft yarn path in a warp yarn system.

In the course of the successive operating cycles of the weaving machine each warp yarn (9–20) is placed, by shed-forming means, at the correct heights in relation to the insertion levels of the rapier devices, so that these warp yarns (9–20) together with the weft yarns form two fabrics located one above the other, in which the warp yarns (9–20) of each warp yarn system have the path in relation to the successive weft yarns schematically represented in FIG. 1.

In each warp yarn system two binding warp yarns (11), (12), and one tension warp yarn (9) are provided in order together with a series of weft yarns (1), (3) to form a top backing fabric, and two binding warp yarns (13), (14) and a tension warp yarn (10) are provided in order together with a series of weft yarns (2), (6) to form a bottom backing fabric. In each backing fabric the successive weft yarns (1), (3); (2), (6) extend in relation to the tension warp yarns (9), (10) alternately along the back and along the top (the sides directed toward each other) of the fabrics.

The weft yarns (1–6) are inserted in successive series of four successive weft insertion cycles, whereby in each case in the first cycle one single weft yarn (1) is inserted which for the formation of the top backing fabric extending above the top tension warp yarns (9) is woven in by the top binding warp yarns (11), (12), in the second cycle in each case one single weft yarn (2) is inserted which for the formation of the bottom backing fabric extending below the bottom tension warp yarns (10) is woven in by the bottom binding warp yarns (13), (14), in the third cycle two weft yarns (3), (4) are inserted one above the other of which the top weft yarn (3) for the formation of the top backing fabric extending below the top tension warp yarns (9) is woven in by the top binding warp yarns (11), (12), and the bottom weft yarn (4) is thicker and extending between the top and the bottom backing fabric is not woven in a backing fabric, but extends over the backing fabric surface (along the pile side) of the top backing fabric.

and in the fourth cycle two weft yarns (5), (6) are inserted one above the other of which the top weft yarn (5) is thicker and extending between the two backing fabrics is not woven into in a backing fabric, but extends over the backing fabric surface (along the pile side) of the bottom backing fabric and the bottom weft yarn (6) for the formation of the bottom backing fabric, extending above the bottom tension warp yarns (10) is woven in by the bottom binding warp yarns (13), (14).

In the cycles in which only one weft yarn is inserted one of the rapier devices is disengaged and/or the presenting means working together with one of the rapier devices is controlled in order in this cycle not to present a weft yarn to the rapier device. In the first cycle a weft yarn (1) is only inserted by the top rapier device. In the second cycle a weft yarn (2) is only inserted by the bottom rapier device. The locations in the fabric where in this manner no weft yarn is inserted, are indicated in FIG. 1 by reference numbers (7) and (8).

In each backing fabric rib warp yarns (15), (16); (17), (18) are alternately woven into in the backing fabric and rib-formingly passed around a weft yarn (4), (5) extending outside the backing fabric and on the backing fabric surface. These weft yarns (4); (5) are thicker than the weft yarns (1), (2), (3), (6) woven into in the backing fabrics so that ribs with a rather high height are formed and a very clear bouclé effect is obtained.

The rib warp yarns (15), (16) of the top fabric form ribs over the thick weft yarns (4) which are woven in during the third cycle. The rib warp yarns (17), (18) of the bottom fabric form ribs over the thick weft yarns (5) which are woven in during of the fourth cycle.

In each warp yarn system two rib warp yarns (15, 16), (17, 18) of a different color are provided for each backing fabric. In accordance with a figure or pattern to be formed in the fabric ribs are formed in specific areas in the fabric with one rib warp yarn (15), (17) while in other areas the other rib warp yarn (16), (18) is used in order to produce the rib structure or the bouclé effect. The rib warp yarn which is not used for forming rib structure in a specific location in a fabric is woven in between the weft yarns (3), (4); (5), (6) inserted together of that fabric, and therefore extends between the backing fabric and the thick weft yarns (4), (5) of the fabric.

Per warp yarn system two pile warp yarns (19), (20) of a different color are also provided. In a number of areas in the fabrics (22), (23) a pile warp yarn (19), (20) is alternately interlaced in the top and the bottom backing fabric by a weft yarn (1), (2), (3) woven in these backing fabrics. Likewise in accordance with the desired appearance of the carpet there are areas in the carpet where one pile warp yarn forms pile and other areas where the other pile yarn forms pile. The pile warp yarns which do not form pile in a specific location are woven in between the weft yarns (3, 4), (5, 6) inserted together of one of the backing fabrics, and therefore likewise extend between the backing fabric and the thick weft yarn (4), (5) of the fabric in question. A pile warp yarn (19), (20) can also be used as rib warp yarn (15–18), and vice versa.

In each warp yarn system one pile warp yarn (19) is woven into in the top backing fabric if it does not form pile, and the other pile warp yarn (20) is woven into the bottom backing fabric if it does not form pile. If the warp yarn systems comprise great numbers of pile warp yarns it is attempted to divide the pile warp yarns to be woven in as far as possible among the two backing fabrics.

In order to obtain a bouclé effect in the top fabric a rib warp yarn (15), (16) is therefore brought to the following heights in the four successive weft insertion cycles of a series: above the insertion level of the top rapier device, between the insertion level of the (disengaged) top and the bottom rapier device, below the insertion level of the bottom rapier device, and above the insertion level of the top rapier device.

In order to obtain a bouclé effect in the bottom fabric a rib warp yarn (17), (18) is brought to the following heights in the four successive weft insertion cycles of a series: between the insertion level of the top and the (disengaged) bottom rapier device, below the insertion level of the bottom rapier device, below the insertion level of the bottom rapier device, and above the insertion level of the top rapier device.

Long false bouclé effect is formed by allowing a rib warp yarn (15), (16), (17), (18) to float over two or more thick weft yarns (4), (5).

The pile warp yarns (19), (20) are split between the two backing fabrics with a cutting means (21) provided on the weaving machine, so that two fabrics (22), (23) are obtained with a rib structure and with areas with cut pile.

In a second very preferred weaving method according to this invention use is made of a known face-to-face weaving machine with a weft insertion mechanism that comprises three rapier devices and respective presenting means operating one above the other. This weft insertion mechanism is therefore provided in order to insert three weft yarns (31, 32, 33), (34, 35, 36) simultaneously one above the other in each operating cycle.

On this face-to-face weaving machine a series of warp yarn systems is provided, each of which comprises four binding warp yarns (39), (40), (41), (42), two tension warp yarns (37), (38), four rib warp yarns (43), (44), (45), (46) and one pile warp yarn.

Figure 2:
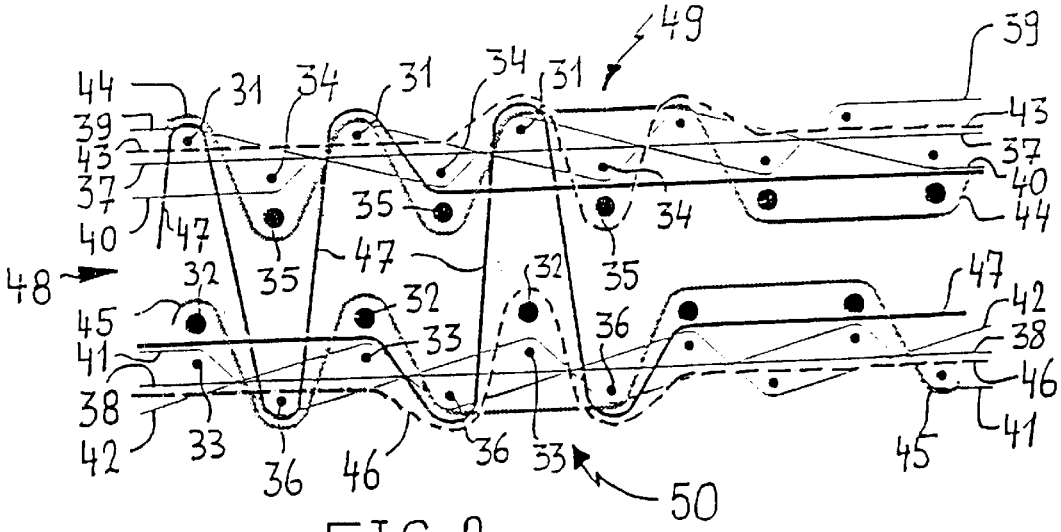
FIG. 2 is a schematic view of another embodiment of a weft yarn path in a warp yarn system.

In the course of the successive operating cycles of the weaving machine the warp yarns (37–47) are placed by shed-forming means at the correct heights in relation to the insertion levels of the three rapier devices, so that these warp yarns (37–47) together with the weft yarns (31–36) form two fabrics (49), (50) located one above the other, in which the warp yarns (37–47) of each warp yarn system have the path in relation to the successive weft yarns (31, 32, 33), (34, 35, 36) schematically represented in FIG. 2.

In each warp yarn system two top binding warp yarns (39), (40) and a bottom tension warp yarn (37) are provided in order to form a top backing fabric together with a series of weft yarns (31), (34), and two bottom binding warp yarns (41), (42) and a bottom tension warp yarn (38) are provided in order to form a bottom backing fabric together with a series of weft yarns (33), (36). In each backing fabric the successive weft yarns (31), (34); (33), (36) extend in relation to the tension warp yarn (37), (38) alternately along the back and along the top (the sides directed toward each other) of the fabrics.

The weft yarns (31–36) are inserted in successive series of two successive weft insertion cycles, whereby in each case

- in the first cycle three weft yarns (31), (32), (33) are inserted one above the other, whereby the top weft yarn (31) extending above the top tension warp yarns (37) is woven in by the top binding warp yarns (39), (40) in order to form the top backing fabric, of which the bottom weft yarn (33) extending above the bottom tension warp yarns (38) is woven in by the bottom binding warp yarns (41), (42) in order to form the bottom backing fabric, and of which the middle weft yarn (32) extends between the two backing fabrics.
- in the second cycle in each case three weft yarns (34), (35), (36) are inserted one above the other, whereby the top weft yarn (34) extending below the top tension warp yarns (37) is woven in by the top binding warp yarns (39), (40) in order to form the top backing fabric, whereby the bottom weft yarn (36) extending below the bottom tension warp yarns (38) is woven in by the bottom binding warp yarns (41), (42) in order to form the bottom backing fabric, and whereby the middle weft yarn (35) extends between the two backing fabrics.

In each backing fabric rib warp yarns (43), (44); (45), (46) are provided which are alternately woven in the backing fabric by a weft yarn (31), (36) located along the back and are rib-formingly passed around a weft yarn (35), (32) extending outside the backing fabric. The rib warp yarns (43), (44) of the top fabric (49) are passed around the weft yarns (35) extending between the backing fabrics which are inserted in the course of the second cycle. These weft yarns (35) extend over the top backing fabric, along the pile side thereof. The rib warp yarns (45), (46) of the bottom fabric are passed around the weft yarns (32) extending between the backing fabrics which are inserted in the course of the first cycle. These weft yarns (32) extend over the bottom backing fabric, along the pile side thereof. In order to obtain a clearer rib structure a thicker yarn is taken for these weft yarns (32), (35) than for the weft yarns (31), (33), (34), (36) woven in the backing fabrics.

With this method a bouclé effect and a plush effect can also be obtained, whereby in each effect areas with different colors are possible through use of several different colored rib warp yarns (43), (44); (45), (46) and pile warp yarns (47). A pile warp yarn (47) can also be used as rib warp yarn (43–46) and vice versa.

The pile warp yarns (47) are split between the two fabrics on the weaving machine by a cutting means (48) so that two fabrics (49), (50) with a rib structure and with areas with cut pile are obtained.

Per series of two successive weft insertion cycles both a rib line and a row of pile burls can be obtained in both fabrics. The productivity of this method is therefore particularly high, while fabrics with a very varied appearance can be woven.

What is claimed is:

1. Method for weaving fabrics with a rib structure, whereby on a weaving machine a backing fabric is woven with weft yarns (1–6); (31–36) and warp yarns (9–20); (37–47), and whereby warp yarns (15–18); (43–46) are alternately woven in the backing fabric and are rib-formingly passed around over at least one weft yarn (4), (5); (32), (35) extending on the backing fabric surface characterized in that two fabrics (22), (23); (49), (50) are woven one above the other with a rib structure according to a face-to-face weaving method, while warp yarns (19), (20); (47) are alternately interlaced in the top (22); (49) and the bottom fabric (23); (50) around at least one weft yarn (1), (2), (3); (31), (36), and that these warp yarns (19), (20); (47) are split between the two fabrics so that each fabric (22), (23); (49), (50) with a rib structure also comprises at least one area with cut pile yarn.

2. Method for manufacturing fabrics with a rib structure according to claim 1 characterized in that two backing fabrics located one above the other are woven respectively out of weft yarns (1, 3), (2–6); (31, 34), (33, 36) and binding warp yarns (11, 12), (13, 14); (39, 40), (41, 42), and that the weft yarns (4), (5); (32), (35) over which warp yarns (15–18); (43–46) are rib-formingly passed around extend on the backing fabrics' surface.

3. Method for manufacturing fabrics with a rib structure according to claim 1 characterized in that the rib-forming warp yarns (15–18); (43–46) are passed around over weft yarns (4), (5); (32), (35) which belong to a set (3, 4), (5, 6); (32, 33), (34, 35) of at least two weft yarns located one above the other.

4. Method for weaving fabrics with a rib structure, according to claim 1, characterized in that a set (3, 4), (5, 6); (32, 33), (34, 35) of weft yarns are located one above the other and one single weft yarn (1), (2); (31), (36) is provided alternately in each fabric.

5. Method for manufacturing fabrics with a rib structure according to claim 1, characterized in that forming ribs over the weft yarns (4), (5); (32), (35) which are thicker than the other weft yarns.

6. Method for manufacturing fabrics with a rib structure according to claim 1 characterized in that tension warp yarns (9), (10); (37), (38) are woven in each backing fabric.

7. Method for manufacturing fabrics with a rib structure according to claim 1 characterized in that non-rib-forming and non-pile-forming warp yarns (15–20); (43–47) are divided among the top (22), (49) and the bottom fabric (23), (50) woven in these fabrics and moreover extend between the weft yarns (4), (5); (32), (35) over which ribs are formed and the other weft yarns (1–3, 6); (31, 33, 34, 36) of the fabric.

8. Method for manufacturing fabrics with a rib structure according to claim 1 characterized in that the weft yarns (1–6) are in the course of successive series of four successive operating cycles of the weaving machine weft insertion means inserted in respective sheds between the warp yarns (9–20), whereby in the first cycle of each series one weft yarn (1) is inserted for the top fabric (22), in the second cycle of each series one weft yarn (2) is inserted for the bottom fabric (23), in the third cycle of each series two weft yarns (3), (4) are inserted one above the other for the top fabric (22), and in the fourth cycle of each series two weft yarns (5), (6) are inserted one above the other for the bottom fabric (23).

9. Method for manufacturing fabrics with a rib structure according to claim 8, characterized in that providing two weft insertion means in order to insert two weft yarns one above the other in the course of the same operating cycle and that in the course of the cycles in which only one weft yarn is inserted, one of the weft insertion means is disengaged or no weft yarn is provided to one of the weft insertion means.

10. Method for manufacturing fabrics with a rib structure according to claim 1 characterized in that the weft yarns (31–36) are in the course of successive series of two successive operating cycles of the weaving machine weft insertion means inserted in respective sheds between the warp yarns (37–47), whereby in each series in one cycle two weft yarns (32), (33) are inserted one above the other for the bottom fabric (50) and one weft yarn (31) is inserted for the top fabric (49), and in the other cycle two weft yarns (34), (35) are inserted one above the other for the top fabric (49) and one weft yarn (36) is inserted for the bottom fabric (50).

11. Method for manufacturing fabrics with a rib structure, according to claim 10, characterized in that providing three weft insertion means in order to insert three weft yarns (31, 32, 33), (34, 35, 36) one above the other in the course of the same operating cycle.

12. Method for manufacturing fabrics with a rib structure according to claim 1, characterized in that at least one warp yarn (15–18); (43–46) extends rib-formingly over two or more successive weft yarns (1–6); (31–36) without interlacing in the fabric.

13. Fabric with a rib structure in which warp yarns (15, 16) (17, 18) (43, 44) (45, 46) are alternately woven into in the fabric and are rib-formingly passed around at least one weft yarn (4), (5); (32), (35), characterized in that the fabric also comprises at least one area with cut pile.

14. Fabric according to claim 13 characterized in that it is a false bouclé carpet with plush effects.

* * * * *